US008351819B2

(12) United States Patent
Sakuma

(10) Patent No.: US 8,351,819 B2
(45) Date of Patent: Jan. 8, 2013

(54) IMAGE FORMING APPARATUS, SUPPORTING MEMBER, AND IMAGE FORMING UNIT

(75) Inventor: Susumu Sakuma, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/572,029

(22) Filed: Aug. 10, 2012

(65) Prior Publication Data

US 2012/0308284 A1 Dec. 6, 2012

Related U.S. Application Data

(63) Continuation of application No. 13/433,372, filed on Mar. 29, 2012, now Pat. No. 8,270,870, which is a continuation of application No. 12/512,305, filed on Jul. 30, 2009, now Pat. No. 8,270,869.

(30) Foreign Application Priority Data

Jul. 31, 2008 (JP) ..... 2008-198188

(51) Int. Cl.
*G03G 15/16* (2006.01)
*G03G 21/00* (2006.01)

(52) U.S. Cl. ..... 399/101; 399/358

(58) Field of Classification Search ..... 399/101, 399/110, 358
See application file for complete search history.

(56) References Cited

U.S. PATENT DOCUMENTS

| | | | |
|---|---|---|---|
| 6,708,011 | B2 | 3/2004 | Nomura et al. |
| 2009/0226205 | A1 | 9/2009 | Sato et al. |

FOREIGN PATENT DOCUMENTS

| | | | |
|---|---|---|---|
| JP | 04-215668 | A | 8/1992 |
| JP | 10-333520 | A | 12/1998 |
| JP | 2003-015378 | A | 1/2003 |
| JP | 2006-171295 | A | 6/2006 |
| JP | 2007-079445 | A | 3/2007 |
| JP | 2007-218936 | A | 8/2007 |

*Primary Examiner* — David Porta
*Assistant Examiner* — Faye Boosalis
(74) *Attorney, Agent, or Firm* — Banner & Witcoff, Ltd.

(57) ABSTRACT

An image forming apparatus includes an endless belt, a plurality of processing units, a cleaning unit, a waste toner retainer, and a waste toner conveying unit. The plurality of processing units is juxtaposed above the endless belt. The cleaning unit is disposed above the endless belt to collect a waste toner deposited on the endless belt. The waste toner retainer is provided in one processing unit in the plurality of processing units. At least one of the other processing units in the plurality of processing units is interposed between the cleaning unit and the one processing unit. The waste toner conveying unit conveys the waste toner collected by the cleaning unit to the waste toner retainer, and extends from the cleaning unit to the waste toner retainer.

1 Claim, 3 Drawing Sheets

IMAGE FORMING APPARATUS, SUPPORTING MEMBER, AND IMAGE FORMING UNIT

CROSS REFERENCE TO RELATED APPLICATION

This application is a continuation of prior U.S. application Ser. No. 13/433,372, filed Mar. 29, 2012, which is a continuation of prior U.S. application Ser. No. 12/512,305, filed Jul. 30, 2009, which claims priority from Japanese Patent Application No. 2008-198188 filed Jul. 31, 2008. The entire content of the priority application is incorporated herein by reference.

TECHNICAL FIELD

The present invention relates to an image forming apparatus such as a printer, and a supporting member and an image forming unit used in the image forming apparatus.

BACKGROUND

It has been well known that, in a conventional tandem type image forming apparatus having a plurality of photosensitive drums juxtaposed with each other in a generally horizontal direction, the photosensitive drums and developing units are disposed above the endless belt, and a cleaning member for collecting waste toner deposited on the endless belt and a waste toner retainer for retaining the collected waste toner are disposed below the belt.

SUMMARY

In such a conventional image forming apparatus having the cleaning member and the waste toner retainer, the cleaning member and the waste toner retainer need to be removed from the image forming apparatus in order to conduct maintenance of the cleaning member and to discard the waste toner retained in the waste toner retainer. However, in the image forming apparatus having the above structure, the developing units, the photosensitive drums, and the belt need to be removed from the image forming apparatus before removing the cleaning member and the waste toner retainer. Thus, removal of the cleaning unit and the waste toner retainer is complicated.

Such a problem can be solved if the cleaning member and the waste toner retainer are disposed above the belt. However, if both of the cleaning member and the waste toner retainer are disposed above the belt, the waste toner retainer is provided at a position above the cleaning member. Hence, conveyance efficiency of the waste toner is lowered.

In view of the foregoing, it is an object of the invention to provide an image forming apparatus having a structure that a cleaning member and a waste toner retainer are disposed above an endless belt and to improve conveyance efficiency of waste toner.

This and other objects of the present invention will be attained by providing an image forming apparatus including an endless belt, a plurality of processing units, a cleaning unit, a waste toner retainer, and a waste toner conveying unit. The plurality of processing units is juxtaposed above the endless belt. The cleaning unit is disposed above the endless belt to collect a waste toner deposited on the endless belt. The waste toner retainer is provided in one processing unit in the plurality of processing units. At least one of the other processing units in the plurality of processing units is interposed between the cleaning unit and the one processing unit. The waste toner conveying unit conveys the waste toner collected by the cleaning unit to the waste toner retainer, and extends from the cleaning unit to the waste toner retainer.

In another aspect of the invention, there is provided a supporting member that is used for an image forming apparatus including an endless belt; a plurality of processing units that is juxtaposed above the endless belt; a cleaning unit that is disposed above the endless belt to collect a waste toner deposited on the endless belt; and a waste toner retainer that is provided in one processing unit in the plurality of processing units. The supporting member includes a pair of side walls and a waste toner conveying unit. The pair of side walls opposes each other and is disposed above the endless belt. Each of the side walls has an inner surface and an outer surface. Each of the inner surfaces is provided with a plurality of mounting portions for mounting the plurality of processing units. The plurality of mounting portions is arranged on the inner surface. The waste toner conveying unit conveys the waste toner collected by the cleaning unit to the waste toner retainer. One of the side walls is formed with a first through hole for discharging the waste toner collected in the cleaning unit into the waste toner conveying unit and a second through hole for the waste toner conveyed by the waste toner conveying unit into the waste toner retainer. The second through hole is located at a lateral side of one mounting portion in the plurality of mounting portions. The one processing unit is mounted on the one mounting portion. At least one of the other mounting portions in the plurality of mounting portions is interposed between the first though hole the second through hole. The waste toner conveying unit is provided on the outer surface of the one of the side walls and extends from the first though hole to the second through hole.

In another aspect of the invention, there is provided an image forming unit that is used for an image forming apparatus including an endless belt. The image forming unit includes a plurality of processing units, a cleaning unit, a waste toner retainer, a supporting member, and a waste toner conveying unit. The plurality of processing units is juxtaposed above the endless belt. The cleaning unit is disposed above the endless belt to collect a waste toner deposited on the endless belt. The waste toner retainer is provided in one processing unit in the plurality of processing units. At least one of the other processing units in the plurality of processing units is interposed between the cleaning unit and the one processing unit. The supporting member integrally supports the processing units, the cleaning unit, and a waste toner retainer. The supporting member includes a side wall having an outer surface. The waste toner conveying unit conveys the waste toner collected by the cleaning unit to the waste toner retainer, extends from the cleaning unit to the waste toner retainer, and is provided at the outer surface of the side wall.

DETAILED DESCRIPTION

A color printer according to an embodiment of the present invention will be described while referring to the accompanying drawings.

Figure 1:
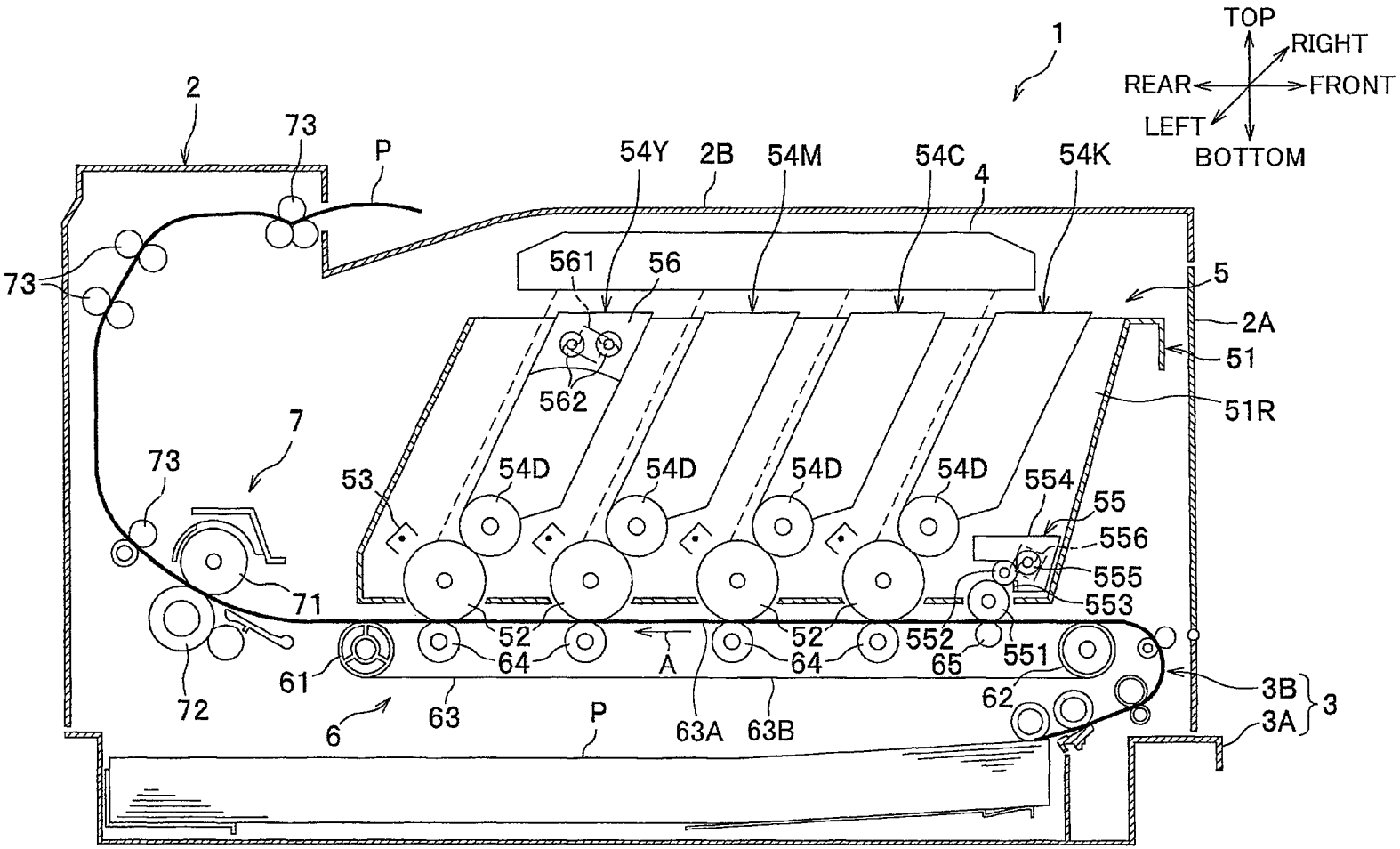
FIG. 1 is a schematic cross-sectional view of a color printer embodying an image forming apparatus according to an embodiment of the present invention.

As shown in FIG. 1, a color printer 1 has a main frame 2 in which a sheet supply unit 3, an exposure unit 4, an image forming unit 5, a transfer unit 6, and a fixing unit 7 are provided.

In the following description, various directions are used based on a state that the color printer 1 is disposed in an orientation in which it is intended to be used. More specifically, in FIGS. 1 through 3, the right side is "front side," the left side is "rear side," the side behind the plane of the drawing is "right side," and the side forward the plane of the drawing is "left side." Further, in FIGS. 1 through 3, a direction orthogonal to both of the front-to-rear direction and the left-to-right direction is referred to as the vertical direction.

The main frame 2 has a front door 2A and a sheet discharge tray 2B. The front door 2A is provided at the front side of the main frame 2, and is pivotally connected to the main frame 2 by a shaft positioned at a lower portion of the front side so as to be pivotally movable frontward and rearward. The sheet discharge tray 2B is provided at a top surface of the main frame 2, and accommodates a sheet P (a recording sheet) discharged outwardly from the main frame 2.

The sheet supply unit 3 includes a sheet supply tray 3A and a sheet supply mechanism 3B. The sheet supply tray 3A is detachably mounted at a lower portion of the main frame 2. The sheet supply mechanism 3B conveys the sheet P from the sheet supply tray 3A onto an endless conveying belt 63. In the sheet supply unit 3, each sheet P accommodated in the sheet supply tray 3A is directed onto the endless conveying belt 63 by the sheet supply mechanism 3B. The endless belt 63 has an upper moving section 63A moving in a moving direction A shown in FIG. 1, and a lower moving section 63B moving in an opposite direction opposite to the moving direction A.

The exposure unit 4 is positioned at an upper portion of the main frame 2. The exposure unit 4 includes a laser emission unit, a polygon minor, a plurality of lenses and a plurality of reflective mirrors (not shown). In the exposure unit 4, the laser emission units are adapted to emit laser beams for each of colors cyan, magenta, yellow, and black onto respective photosensitive drums 52 at a high speed, after the laser beams have been reflected by the reflective minors and have passed through the lenses.

The image forming unit 5 is disposed above the sheet supply unit 3 and below the exposure unit 4. The image forming unit 5 includes a supporting frame 51, four photosensitive drums 52, four chargers 53, four developing cartridges 54 (54K, 54C, 54M, and 54Y), and a cleaning unit 55 including a first retainer 554.

The supporting frame 51 integrally supports the photosensitive drums 52, the chargers 53, the developing cartridges 54 and the cleaning unit 55. The supporting frame 51 is movable in a front-to-rear direction (in an alignment direction of the photosensitive drums 52 and the developing cartridges 54) relative to the main frame 2, and capable of being pulled out of the main frame 2 when the front door 2A is opened. Details of the supporting frame 51 will be described later.

The photosensitive drums 52 are juxtaposed with each other in the front-to-rear direction, and rotatably supported relative to the supporting frame 51.

Each of the chargers 53 applies a positive charge to a surface of each photosensitive drum 52. The charger 53 is disposed diagonally above and rearward of the photosensitive drum 52, and opposes the photosensitive drum 52.

Each of the developing cartridges 54 is disposed diagonally above and frontward of each photosensitive drum 52, and is juxtaposed in the front-to-rear direction in order of 54K, 54C, 54M, and 54Y from the front side of the supporting frame 51. More specifically, the developing cartridge 54Y is provided at a position down-most stream in the moving direction A of the upper moving section 63A of the endless conveying belt 63. Each developing cartridge 54 includes a developing roller 54D for supplying toner (developing agent) to the photosensitive drum 52, a toner supply roller, a blade for regulating a toner layer thickness, a toner chamber for accommodating new toner, and an agitator (not shown). Each of the developing cartridges 54 is detachably mounted relative to the supporting frame 51.

The developing cartridges 54K, 54C, and 54M have the same structure, while colors of the toner accommodated therein are the only difference between these developing cartridges. The developing cartridge 54Y has an upper section provided with a second retainer 56 for storing waste toner. The developing cartridges 54K, 54C, and 54M are interposed between the cleaning unit 55 and the developing cartridge 54Y. Details of the second retainer 56 and the cleaning unit 55 will be described later.

The transfer unit 6 is disposed above the sheet supply unit 3 and below the image forming unit 5. The transfer unit 6 includes a drive roller 61, a driven roller 62, and the endless conveying belt 63, and four transfer rollers 64.

The drive roller 61 and the driven roller 62 are arranged parallel to each other and spaced away from each other in the front-to-rear direction. The endless conveying belt 63 is looped around the drive roller 61 and the driven roller 62. The endless conveying belt 63 is circularly movable by the rotation of the drive roller 61. An outer surface of the upper moving section 63A of the endless conveying belt 63 is in contact with the photosensitive drums 52.

The transfer rollers 64 are disposed at an inner peripheral side of the endless conveying belt 63 and opposite to the photosensitive drums 52. The transfer rollers 64 pinch the endless conveying belt 63 in cooperation with the photosensitive drums 52. A transfer bias is applied to each of the transfer rollers 64 when transferring.

A backup roller 65 is located at the front side of the transfer roller 64 and opposes a cleaning roller 551 of the cleaning unit 55. The backup roller 65 pinches the endless conveying belt 63 in cooperation with the cleaning roller 551. The backup roller 65 has a roller shaft which is electrically grounded.

The fixing unit 7 is provided at the rear side of the image forming unit 5 and the transfer unit 6, and includes a heat roller 71 and a pressure roller 72. The pressure roller 72 is disposed opposite to the heat roller 71 so as to press the same.

In the color printer 1 as configured above, firstly, each surface of the photosensitive drums 52 is uniformly charged by the chargers 53. Then, the surfaces of the photosensitive drums 52 are exposed by the laser beams for each of the colors emitted from the exposure unit 4, so that electrostatic latent images based on image data are formed on the surfaces of the photosensitive drums 52. Subsequently, the developing rollers 54D of the developing cartridges 54 supply the toner to the electrostatic latent images formed on the surfaces of the photosensitive drums 52. Therefore, visible toner images corresponding to the electrostatic latent images can be formed on the surfaces of the photosensitive drums 52.

The sheet P supplied from the sheet supply unit 3 is conveyed between the photosensitive drums 52 and the transfer rollers 64, so that the visible toner images formed on the surfaces of the photosensitive drums 52 are sequentially transferred onto the sheet P. The visible toner images transferred onto the sheet P is thermally fixed while the sheet P is conveyed between the heat roller 71 and the pressure roller 72. The sheet P, on which the visible toner images have been thermally fixed, is discharged outwardly from the main frame 2 by a plurality of discharge rollers 73, and accommodated on the discharge tray 2B.

Next, the cleaning unit 55, the second retainer 56, and the supporting frame 51 will be described in detail. The "waste toner" implies that toner supplied to the photosensitive drums 52 and transferred onto the sheet P is deposited on the endless conveying belt 63 due to paper jam and the like.

As shown in FIG. 1, the cleaning unit 55 collects the waste toner deposited on the endless conveying belt 63. The cleaning unit 55 is disposed above the endless conveying belt 63 and at the front side of the developing cartridge 54K. The cleaning unit 55, the photosensitive drums 52 and the developing cartridges 54 are juxtaposed in the front-to-rear direction. More specifically, the cleaning unit 55 is provided at a position uppermost stream in the moving direction A of the upper moving section 63A of the endless conveying belt 63. Further, the cleaning unit 55 is detachably mounted relative to the supporting frame 51 (not shown).

The cleaning unit 55 includes the cleaning roller 551, a collecting roller 552, a scraper blade 553, the first retainer 554, and a first auger 555.

The cleaning roller 551 is rotatably supported relative to the supporting frame 51 and is slidingly in contact with the outer surface of the upper moving section 63A of the endless conveying belt 63, so as to be capable of removing the waste toner from the endless conveying belt 63. The cleaning roller 551 has a roller body of which a roller shaft made from metal is coated with an electrically conductive forming material, such as silicone and urethane.

The collecting roller 552 is made from a hard material such as metal (for example, a metal roller). The collecting roller 552 is rotatably provided diagonally above the cleaning roller 551, and is pressingly in contact with the cleaning roller 551.

The scraper blade 553 is disposed frontward of the collecting roller 552. The scraper blade 553 is pressingly in contact with the collecting roller 552, so as to scrape off the waste toner deposited on the collecting roller 552.

The first retainer 554 temporally stores the waste toner scraped off by the scraper blade 553. The first auger 555 is rotatably provided within the first retainer 554 extending in a left-to-right direction. A first opening 556 is formed on a left side wall of the first retainer 554. The waste toner temporally stored in the first retainer 554 is conveyed to the left side of the first retainer 554 in association with rotation of the first auger 555, and is further conveyed to a waste toner conveying unit 57 through the first opening 556 and an outlet port 512 described later.

As shown in FIG. 1, the second retainer 56 is a container like member for storing the waste toner collected by the cleaning unit 55. The second retainer 56 is integrally formed with the developing cartridge 54Y. More specifically, the developing cartridge 54Y is divided into two sections, that is, upper and lower sections. The upper and lower sections respectively serve as the second retainer 56 and the toner chamber (not shown).

The second retainer 56 has a left side wall where a second opening 561 is formed. The second opening 561 is in fluid communication with an opening formed on the waste toner conveying unit 57 and an inlet port 513, when the developing cartridge 54Y is mounted on the supporting frame 51. Further, a pair of second augers 562 is provided within the second retainer 56 respectively extending in the left-to-right direction. The second augers 562 conveys the waste toner received from the second opening 561 to a right side of the second retainer 56 in order to prevent the waste toner from being accumulated around the second opening 561.

Figure 2:
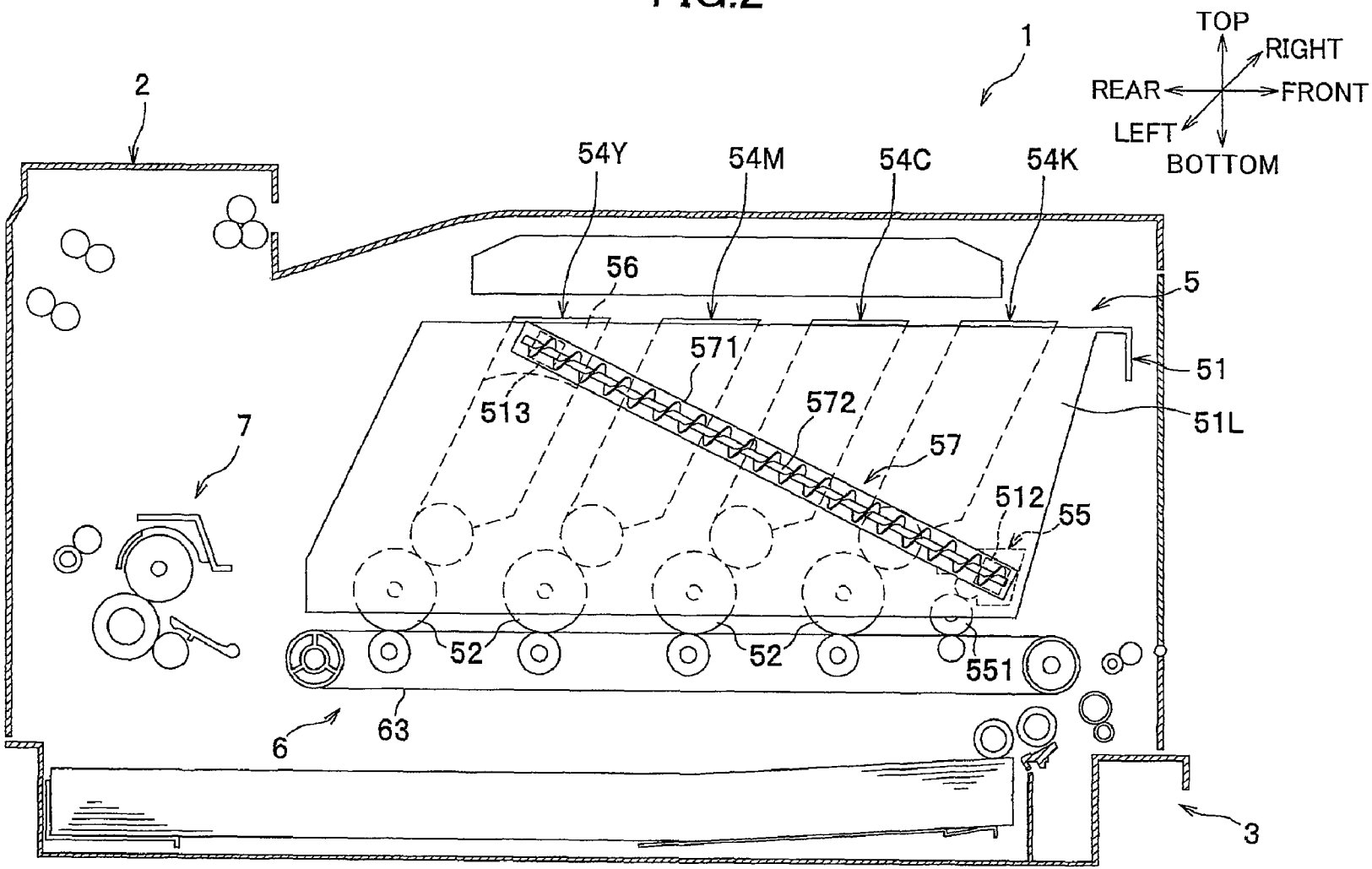
FIG. 2 is a schematic cross-sectional view particularly showing a waste toner conveying unit in the color printer according to the embodiment.
Figure 3:
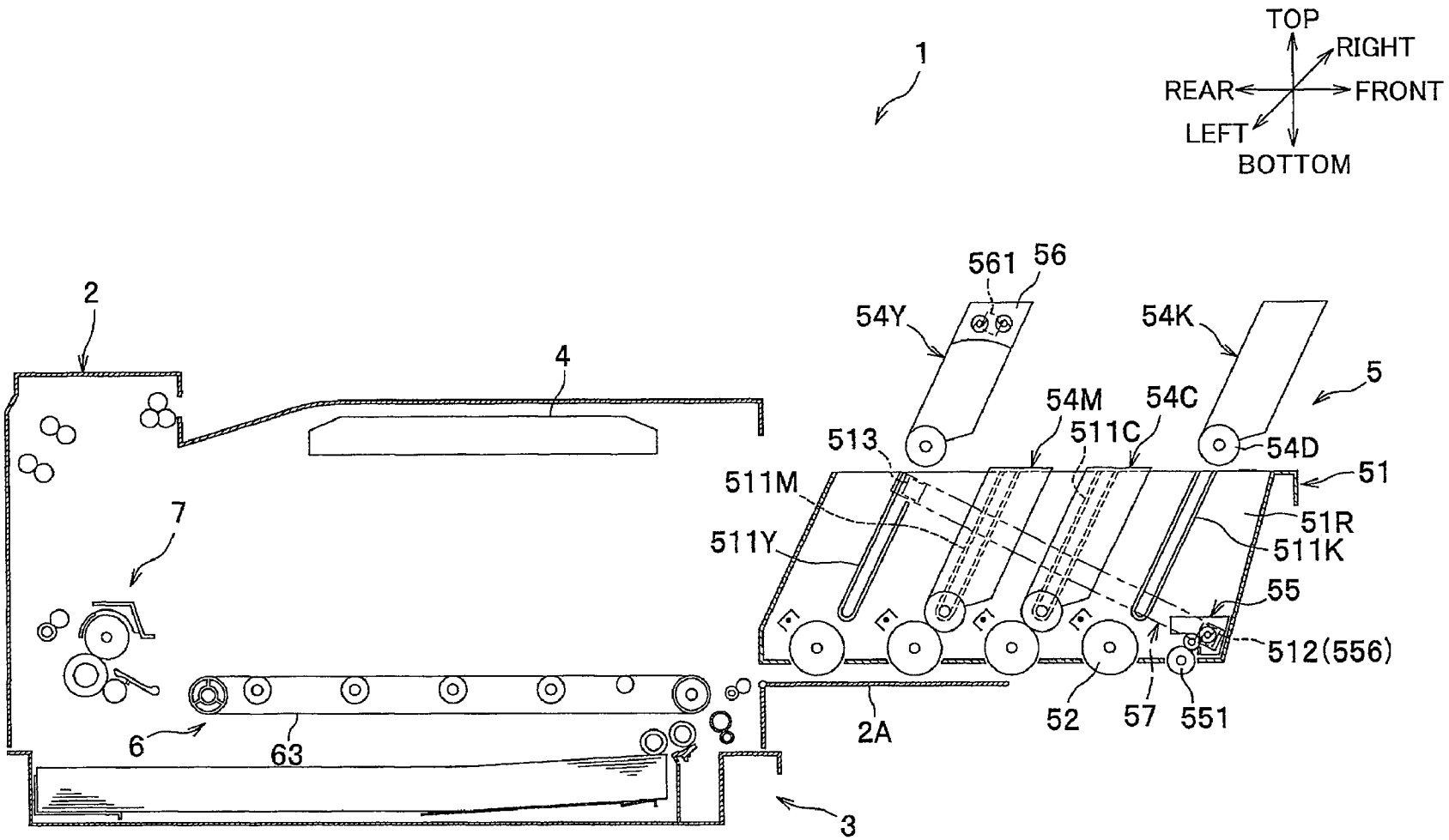
FIG. 3 is a schematic cross-sectional view of the color printer in which a supporting frame is pulled out of a main frame according to the embodiment.

As shown in FIGS. 1 through 3, the supporting frame 51 is formed in a generally box-shape having an opening in an upper portion. Further, the supporting frame 51 has a plurality of openings (no reference numerals) in the bottom side thereof, so that lower portions of the photosensitive drums 52 and the cleaning roller 551 protrude from the openings. The supporting frame 51 has a pair of side walls in the left-to-right direction, that is, a right side wall 51R and a left side wall 51L, and the waste toner conveying unit 57. The waste toner conveying unit 57 is provided at an outer surface of the left side wall 51L.

As shown in FIG. 3, each of inner surfaces of the side walls 51R and 51L has four mounting portions 511 (511K, 511C, 511M, and 511Y) in which the developing cartridges 54 are detachably mounted (only the right side wall 51R is delineated in FIG. 3). The mounting portions 511 are arranged in the front-to-rear direction in order of 511K, 511C, 511M, 511Y from the front side of the supporting frame 51. Further, as shown in FIG. 2, the left side wall 51L is formed with the outlet port 512 and the inlet port 513.

The outlet port 512 is a through hole for discharging the waste toner collected in the cleaning unit 55 into the waste toner conveying unit 57. The outlet port 512 is positioned at the front side of the mounting portion 511K. The outlet port 512 is aligned with the first opening 556 formed in the first retainer 554 in the left-to-right direction, so as to be in fluid communication with the first opening 556.

The inlet port 513 is a through hole for discharging the waste toner conveyed by the waste toner conveying unit 57 into the second retainer 56. The inlet port 513 is located at the lateral side of the upper portion of the mounting portion 511Y. The mounting portion 511Y mounts the developing cartridge 54Y provided with the second retainer 56. The mounting portion 511K, 511C, and 511M are interposed between the outlet port 512 and the inlet port 513. The inlet port 513 is aligned with the second opening 561 formed in the second retainer 56 in the left-to-right direction, so as to be in fluid communication with the second opening 561.

The waste toner conveying unit 57 conveys the waste toner collected in the cleaning unit 55 to the second retainer 56. The waste toner conveying unit 57 includes a tubular portion, of which both ends are closed, defining a waste toner conveying passage 571, and a third auger 572.

The toner conveying passage 571 has upper and lower portions, in confrontation with the left side wall 51L, which are respectively formed with an opening (not shown) in fluid communication with the outlet port 513 and another opening (not shown) in fluid communication with the inlet port 512.

The third auger 572 is provided within the waste toner conveying passage 571. The third auger 572 conveys the waste toner from a downward position to a diagonally upward position in the waste toner conveying passage 571.

The waste toner conveying unit 57 extends from the cleaning unit 55 to the second retainer 56 diagonally upward toward the rear side of the supporting frame 51 crossing each lateral side of the developing cartridges 54K, 54C, and 54M. In other wards, the waste toner conveying unit 57 extends from the outlet port 512 to the second retainer 56 diagonally upward toward the rear side of the supporting frame 51 crossing each lateral side of the mounting portions 511K, 511C, and 511M.

Next, an operation of the color printer 1 configured as above will be described. When a cleaning operation is performed, biases according to charging characteristics of the waste toner are applied to the cleaning roller 551 and the collecting roller 552 based on a publicly known mechanism, respectively. More specifically, the biases are applied to the cleaning roller 551 and the collecting roller 552, so that the waste toner moves onto the cleaning roller 551 from the endless conveying belt 63, and then, moves onto the collecting roller 552 from the cleaning roller 551.

As shown in FIG. 1, the upper moving section 63A of the endless conveying belt 63 moves in the moving direction A in association with the rotation of the drive roller 61. A drive mechanism (not shown) rotates the cleaning roller 551 in a counter clockwise direction in FIG. 1. That is, the cleaning roller 551 rotates in a direction opposite to the moving direction A of the upper moving section 63A of the endless conveying belt 63. The waste toner deposited on the outer surface of the endless conveying belt 63 is scraped off with the cleaning roller 551 and is attracted by the bias applied to the cleaning roller 551. Accordingly, the waste toner moves onto the cleaning roller 551 from the endless conveying belt 63 at a position where the cleaning roller 551 opposes the backup roller 65.

The waste toner moved onto the cleaning roller 551 further moves onto the collecting roller 552 by an attraction force of the bias applied to the collecting roller 552. Then, the waste toner on the collecting roller 552 is scarped off by the scraper blade 553 to be retained in the first retainer 554. The waste toner retained in the first retainer 554 is conveyed to the left side of the first retainer 554 in association with the rotation of the first auger 555, and thereby moving to the lower portion of the waste toner conveying passage 571 through the first opening 556 and the outlet port 512. Subsequently, the waste toner in the lower portion of the waste toner conveying passage 571 is conveyed diagonally upward toward the upper portion of the waste toner conveying passage 571 in association with rotation of the third auger 572 with crossing each lateral side of the developing cartridges 54K, 54C, and 54M (the mounting portions 511K, 511C, and 511M).

The waste toner conveyed to the upper portion of the waste toner conveying passage 571 is conveyed to the second retainer 56 through the inlet port 513 and the second opening 561 to be retained in the second retainer 56. The waste toner is conveyed to the right side of the second retainer 56 in association with rotation of the second augers 562 in order to prevent the waste toner from being accumulated around the second opening 561. As described above, the waste toner deposited on the endless conveying belt 63 is collected by the cleaning unit 55, conveyed to the second retainer 56, and retained in the same.

When the waste toner is discarded, when the developing cartridge 54 is replaced, and when maintenance is performed for the cleaning unit 55, as shown in FIG. 3, the supporting frame 51 is pulled out from the main frame 2 in the frontward direction through the front door 2A pivotally opened in the frontward direction.

The developing cartridge 54Y is removed from the supporting frame 51, and the waste toner retained in the second retainer 56 is discarded. After the waste toner has been discarded, the developing cartridge 54Y is again mounted on the supporting frame 51. Alternatively, the developing cartridge 54Y is removed from the supporting frame 51, and a new developing cartridge 54Y (in which the second retainer 56 is empty) is mounted in the supporting frame 51. When the developing cartridge 54 is replaced, the developing cartridge 54 is removed from the supporting frame 51, and a new developing cartridge 54 is mounted in the supporting frame 51.

When the maintenance is performed for the cleaning unit 55 (not shown), the cleaning unit 55 is removed from the supporting frame 51. Subsequent to the maintenance (cleaning) of the cleaning roller 551, the cleaned cleaning unit 55 is mounted on the supporting frame 51. When the cleaning unit 55 is replaced, the cleaning unit 55 is removed from the supporting frame 51, and a new cleaning unit 55 is mounted on the supporting frame 51.

According to the above, the following effects can be obtained in the present embodiment. In the color printer 1 and the image forming unit 5, the second retainer 56 is disposed at the upper section of one of the developing cartridges 54 (54Y) except for the developing cartridge 54K adjacent to the cleaning unit 55. The waste toner conveying unit 57 extends from the cleaning unit 55 to the second retainer 56 diagonally upward toward the rear side of the supporting frame 51 crossing at least the lateral side of the developing cartridge 54K adjacent to the cleaning unit 55.

Further, in the supporting frame 51, the inlet port 513 formed in the left side wall 51L is located at the lateral side of one of the mounting portions 511 (511Y) except for the mounting portion 511K adjacent to the outlet port 512. The waste toner conveying unit 57 extends from the cleaning unit 55 to the second retainer 56 diagonally upward toward the rear side of the supporting frame 51 crossing at least the lateral side of the mounting portion 511K adjacent to the outlet port 512.

Accordingly, compared with a structure that the second retainer 56 is disposed immediate above the cleaning unit 55 or above the developing cartridge 54K and the inlet port 513 is formed immediate above the outlet port 512 or at the lateral side of the mounting portion 511K, the waste toner conveying unit 57 can be set a gentle slant. Thus, conveyance efficiency of the waste toner by the waste toner conveying unit 57 can be improved.

In particular, according to the present embodiment, the cleaning unit 55 (or the outlet port 512) is provided (or formed) at a position uppermost stream in the moving direction A of the upper moving section 63A of the endless conveying belt 63. Further, the second retainer 56 (or the inlet port 513) is provided (or formed) at a position down-most stream in the moving direction A of the upper moving section 63A of the endless conveying belt 63. Accordingly, the waste toner conveying unit 57 can be set a gentlest slant, so that further improvement in conveyance efficiency of the waste toner by the waste toner conveying unit 57 can be achieved.

The color printer 1 has the supporting frame 51 in which the developing cartridges 54, the cleaning unit 55, and the second retainer 56 are integrally supported. The supporting frame 51 is movable in the front-to-rear direction and capable of being pulled out of the main frame 2. Accordingly, pulling out the supporting frame 51 from the main frame 2 can facilitate the replacement and maintenance of the developing cartridges 54, the second retainer 56 and the cleaning unit 55. In addition, the replacement and maintenance of the cleaning unit 55 can be easily performed without removing the endless conveying belt 63.

According to the present embodiment, the waste toner conveying unit 57 is located at the outer surface of the left side wall 51L. Accordingly, compared with a structure that the waste toner conveying unit 57 is provided at an inner surface of the side wall 51L, a structure for removing and mounting the developing cartridges 54 (the structure of the mounting portions 511, for example) can be simplified.

The second retainer 56 is integral with the developing cartridge 54Y, so that the second retainer 56 can be replaced in association with the replacement of the developing cartridge 54Y. Further, according to the present embodiment, the developing cartridge 54Y has a size in a vertical direction the same as that of the developing cartridges 54K, 54C, and 54M. Therefore, compared with a structure that the second retainer 56 is separately provided at a position above the developing cartridge 54Y, the color printer 1 can be downsized in the vertical direction.

While the invention has been described in detail with reference to the specific embodiment thereof, it would be apparent to those skilled in the art that various changes and modifications may be made therein without departing from the spirit of the invention.

According to the above described embodiment, the cleaning roller 551 (or the outlet port 512) is provided (or formed) at a position uppermost stream in the moving direction A of the upper moving section 63A of the endless conveying belt 63, and the second retainer 56 (or the inlet port 513) is provided (or formed) at a position down-most stream in the moving direction A of the upper moving section 63A of the endless conveying belt 63. However, the cleaning roller 551 (or the outlet port 512) may be provided (or formed) at a position down-most stream in the moving direction A of the upper moving section 63A of the endless conveying belt 63, and the second retainer 56 (or the inlet port 513) may be provided (or formed) at a position uppermost stream in the moving direction A of the upper moving section 63A of the endless conveying belt 63.

According to the above described embodiment, the second retainer 56 (or the inlet port 513) is disposed at the upper section of the developing cartridge 54Y (or at the lateral side of the mounting portion 511Y). However, the second retainer 56 (or the inlet port 513) may be disposed (or formed) at an upper section of any one of the developing cartridges 54C and 54M (or at a lateral side of one of the mounting portions 511C and 511M). Even if this is the case, compared with a structure that the second retainer 56 (or the inlet port 513) is disposed (or formed) immediate above the cleaning roller 551 (or the outlet port 512) or at an upper section of the developing cartridge 54K (or at a lateral side of the mounting portion 511K), the waste toner conveying unit 57 can be set a gentle slant.

If the second retainer 56 (or the inlet port 513) is provided (or formed) at an upper section of the developing cartridge 54C (or at a lateral side of the mounting portion 511C), the waste toner conveying unit 57 extends from the cleaning unit 55 to the second retainer 56 diagonally upward toward the rear side of the supporting frame 51 crossing the lateral side of the developing cartridge 54K (or the mounting portion 511K). Further, if the second retainer 56 (or the inlet port 513) is provided (or formed) at an upper section of the developing cartridge 54M (or at a lateral side of the mounting portion 511M), the waste toner conveying unit 57 extends from the cleaning unit 55 to the second retainer 56 diagonally upward toward the rear side of the supporting frame 51 crossing each lateral side of developing cartridges 54K and 54C (or the mounting portions 511K and 511C).

According to the above described embodiment, the supporting frame 51 is movable in the front-to-rear direction relative to the main frame 2 and is capable of being pulled out of the main frame 2. However, the supporting frame 51 may be movable in the right-to-left direction relative to the main frame 2 and is capable of being pulled out of the main frame 2. Further, while the supporting frame 51 is capable of being pulled out of the main frame 2 according to the present embodiment, the supporting frame 51 may not be capable of being pulled out of the main frame 2. In this case, the main frame 2 may have a top cover positioned at an upper portion and pivotally movably provided. The replacement and maintenance of the developing cartridges 54, the cleaning unit 55, and the second retainer 56 may be conducted through the top cover. If the replacement and maintenance of the cleaning unit 55 is performed through the top cover, the color printer 1 may not need to have the supporting frame 51.

According to the above described embodiment, the waste toner conveying unit 57 is provided at the outer surface of the left side wall 51L of the supporting frame 51. However, the waste toner conveying unit 57 may be provided at an outer surface of the right side wall 51R of the supporting frame 51. Further, the waste toner conveying unit 57 may be provided at the respective outer surfaces of the side walls 51L and 51R of the supporting frame 51. Further, the waste toner conveying unit 57 may be provided at an inner surface of the side wall 51L or 51R of the supporting frame 51.

According to the above described embodiment, the side wall 51L of the supporting frame 51 is formed with the inlet port 513. However, the side wall 51L of the supporting frame 51 may not be formed with the inlet port 513. The upper portion of the waste toner conveying passage 571 may extend upward above an upper edge of the side wall 51L so as to be directly in fluid communication with the second retainer 56.

According to the above described embodiment, the second retainer 56 is integrally formed with the developing cartridge 54Y. However, the second retainer 56 may be detachable from the developing cartridge 54Y. In this case, the second retainer 56 and the developing cartridge 54Y can be separately replaced. Therefore, it can be more cost effective.

According to the above described embodiment, the cleaning roller 551 is a roller body. However, the cleaning roller 551 may be a blade-like or brush like member. In addition, the cleaning roller 551 may not be in contact with the endless conveying belt 63 while the color printer 1 is in an image forming process or is on stand-by.

According to the above described embodiment, the third auger 572 conveys the waste toner. However, a belt-like member may be used for conveying the waste toner in the waste toner conveying passage 571.

According to the above described embodiment, the endless conveying belt 63 is provided. However, an intermediate transfer belt is also available.

According to the above described embodiment, the developing cartridge 54 includes the developing roller 54D, the toner supply roller, and the toner chamber. However, the developing cartridge 54 may include a photosensitive drum (a photosensitive body). Further, the developing cartridge 54 may be separable into a unit including the developing roller 54D and the toner supply roller, and the toner chamber.

According to the above described embodiment, the supporting frame 51 is formed in the generally box-shape having the opening in the upper portion. However, the supporting frame 51 may be formed in a frame-like shape without upper and bottom plates.

The above described embodiment pertains to the color printer 1. However, the present invention is also available for a copying machine and a multifunction apparatus. Further, in the above described embodiment, the photosensitive drum 52 is exposed by the laser beam. However, a photosensitive drum which is exposed by light emitted from an LED (light-emitting diode), an EL (electroluminescence) element, and a fluorescent material is also available.

What is claimed is:

1. An image forming apparatus comprising:

a casing;

a fixing unit accommodated in the casing to fix toner on a recording sheet;

a plurality of developing units arranged parallel to each other in the casing, each of the plurality of developing units comprising a photosensitive drum which has an axis extending in an axial direction and a developing roller;

a plurality of toner cartridges arranged parallel to each other in the casing, each of the plurality of toner cartridges corresponding to each of the plurality of developing units, each of the plurality of toner cartridges having a first accommodating portion configured to accommodate toner, the plurality of toner cartridges including a first toner cartridge and second toner cartridges, the first toner cartridge being positioned closer to the fixing unit than the second toner cartridges when the plurality of toner cartridges is mounted on the casing;

a belt disposed in confrontation with the plurality of the photosensitive drums;

a collecting member in contact with the belt to collect a waste toner remained on the belt;

a first conveying member configured to convey the waste toner collected by the collecting member in the axial direction;

a waste toner conveying passage configured to allow the waste toner conveyed by first conveying member to pass; and a second conveying member configured to convey the waste toner passing through the waste toner conveying passage in the axial direction, wherein the first toner cartridge further comprises a second container in which the waste toner conveyed by the second conveying member is stored, and each of the second toner cartridges does not comprise a second container in which the waste toner conveyed by the second conveying member is stored.

* * * * *